US010144543B2

(12) United States Patent
Caenen et al.

(10) Patent No.: US 10,144,543 B2
(45) Date of Patent: Dec. 4, 2018

(54) METHODS FOR PACKAGING FIBROUS MATERIALS

(71) Applicant: Celanese Acetate LLC, Irving, TX (US)

(72) Inventors: Philip Caenen, Lanaken (BE); Mark Johnson, Derbeyshire (GB); Davy Myny, Zonhoven (BE); Nico Schepers, Lanaken (BE)

(73) Assignee: ACETATE INTERNATIONAL LLC, Irving, TX (US)

( * ) Notice: Subject to any disclaimer, the term of this patent is extended or adjusted under 35 U.S.C. 154(b) by 493 days.

(21) Appl. No.: 14/581,170

(22) Filed: Dec. 23, 2014

(65) Prior Publication Data

US 2015/0239586 A1 Aug. 27, 2015

(30) Foreign Application Priority Data

Feb. 21, 2014 (EP) ..... 14156260

(51) Int. Cl.

| | |
|---|---|
| ***B65B 11/48*** | (2006.01) |
| ***B65B 27/12*** | (2006.01) |
| ***B65B 63/02*** | (2006.01) |
| ***B65B 11/58*** | (2006.01) |

(52) U.S. Cl.

CPC ..... *B65B 11/48* (2013.01); *B65B 11/58* (2013.01); *B65B 27/125* (2013.01); *B65B 63/02* (2013.01)

(58) Field of Classification Search

USPC ..... 53/438, 436, 419, 133.5, 218, 383, 209, 53/387.1; 493/116, 382, 78, 128, 264, 493/347; 206/388, 442, 83.5

See application file for complete search history.

(56) References Cited

U.S. PATENT DOCUMENTS 1,344,785 A * 6/1920 Angier ..... B65B 27/125 100/102
2,393,347 A * 1/1946 Stuart ..... B31C 3/02 156/195
2,425,301 A * 8/1947 Browner ..... B65D 85/16 206/83.5

(Continued)

FOREIGN PATENT DOCUMENTS

AU 3302184 A 1/1985
AU 737531 B2 8/2001

(Continued)

OTHER PUBLICATIONS

European Search Report dated Jun. 27, 2014 for EP Patent Application No. 14156260.3, 6 pages.

(Continued)

*Primary Examiner* — Hemant M Desai
*Assistant Examiner* — Tanzim Imam
(74) *Attorney, Agent, or Firm* — Kilpatrick Townsend & Stockton LLP

(57) ABSTRACT

Disclosed are methods for packaging fibrous materials such as cellulose acetate tow bales. The method may comprise placed a fibrous material between an upper sheet and a lower sheet, folding the upper and lower sheets around the fibrous material, and connecting the upper sheet and lower sheet with a tape, such as a pressure sensitive adhesive tape.

13 Claims, 5 Drawing Sheets

(56) References Cited

U.S. PATENT DOCUMENTS 2,765,838 A * 10/1956 Brown ..... B30B 9/3003 156/475
2,858,657 A * 11/1958 Guthrie ..... B65B 27/125 53/218
2,901,873 A * 9/1959 Enos, Jr. ..... B65D 5/327 229/122.21
2,979,871 A * 4/1961 Kieckhefer ..... B65B 11/58 206/451
3,040,473 A * 6/1962 Wetzler ..... A47C 31/105 227/52
3,206,021 A * 9/1965 Smith ..... B65D 71/00 100/1
3,254,467 A * 6/1966 Garrow ..... B30B 9/3082 100/90
3,792,563 A * 2/1974 Mercer ..... B65B 27/125 53/209
3,816,970 A * 6/1974 Van Doorn ..... B65B 27/125 53/528
3,962,846 A 6/1976 Neitzel et al.
4,157,754 A * 6/1979 Bartsch ..... B65D 85/08 206/83.5
4,331,718 A 5/1982 Gleichechagen et al.
4,746,011 A 5/1988 McNair, Jr. et al.
5,131,210 A * 7/1992 Kiya ..... B65B 27/125 100/247
5,226,269 A 7/1993 Stoltenberg
5,732,531 A * 3/1998 de Silva ..... B65D 85/16 229/87.01
5,979,145 A * 11/1999 Louis ..... B65B 63/022 100/151
6,815,069 B2 11/2004 Hohberg et al.
6,924,029 B1 8/2005 Caenen et al.
7,165,376 B2 * 1/2007 Kawashima ..... B65B 31/00 206/213.1
7,487,720 B2 2/2009 Bundren et al.
7,585,441 B2 9/2009 Caenen et al.
7,585,442 B2 9/2009 Caenen et al.
7,610,852 B2 11/2009 Bundren et al.
8,161,716 B2 4/2012 Hibi et al.
8,308,624 B2 11/2012 Travers et al.
2005/0161358 A1 * 7/2005 Kern ..... B31C 13/00 206/388
2005/0284775 A1 * 12/2005 McLaughlin ..... A01F 25/14 206/83.5
2011/0023898 A1 2/2011 Hibi et al.
2012/0024475 A1 * 2/2012 Kitajima ..... B29C 65/4825 156/312
2012/0255672 A1 * 10/2012 Marshall ..... B32B 3/04 156/216
2013/0233485 A1 9/2013 Herr et al.
2014/0004765 A1 1/2014 Kerep et al.
2014/0110465 A1 4/2014 Krause et al.
2014/0203018 A1 7/2014 Kerep

FOREIGN PATENT DOCUMENTS

DE 28 45 541 A1 6/1980
EP 1 336 683 B1 6/2008
EP 2 631 278 A1 8/2013
GB 1 512 804 A 6/1978
WO 2012/150099 A1 11/2012
WO 2013/037648 A2 3/2013

OTHER PUBLICATIONS

International Search Report and Written Opinion of the International Searching Authority dated Feb. 23, 2015 for PCT Patent Application No. PCT/US2014/072131, 11 pages.

* cited by examiner

METHODS FOR PACKAGING FIBROUS MATERIALS

CROSS-REFERENCE TO RELATED APPLICATION

This application claims priority to European Patent Application 14156260.3, filed Feb. 21, 2014, the entirety of which is incorporated herein by reference.

FIELD OF THE INVENTION

The present invention relates generally to methods for packaging a fibrous material using at least an upper sheet, a lower sheet, and a tape. In particular, the present invention relates to a method for packaging cellulose acetate tow bales using an upper packaging layer, a lower packaging layer, and a perimeter pass of a tape.

BACKGROUND OF THE INVENTION

Methods and materials for packaging fibrous materials are known. Cellulose acetate tow, for example, is a fibrous material that is typically compressed into a bale for packaging, storage and shipment. Cellulose acetate tow is a continuous band or bundle of cellulose filaments that may be processed into cigarette filters. Generally, cellulose acetate tow has low bulk density, e.g., approximately 100 kg/m3, and is compressed to increase this bulk density for improved handling and transport efficiency. After being compressed into a bale, cellulose acetate tow exerts an expansion force, which must be effectively controlled in order to maintain the desired bulk density and size for storage and shipment. Packaging materials, such as polyester straps, are typically used to counteract the expansion force of the tow bale and must be able to withstand a significant internal pressure, which may be on the order of up to 35 N/cm2 just prior release of the compressed tow into the packaging. The packaging materials must also be able to sustain an internal force of up to 5 N/cm2 once the tow bale is packaged.

Numerous packaging methods have been suggested by the prior art. U.S. Pat. No. 8,161,716 discloses a packaging method for a filter tow bale including excessively compressing a distance between press bases to a height lower than a desired height of a packaged bale by 50 to 250 mm, more preferably 80 to 200 mm, further preferably 90 to 180 mm, then adjusting the distance between the press bases to the desired height in a packaged or non-packaged state, and then releasing a pressing force applied on a pressed bale.

U.S. Pat. No. 5,732,531 discloses a method for wrapping a bale of compressed, resilient fibers comprising the steps of: providing a reusable bale wrap kit which includes at least two pieces. Each piece, when joined with the other piece, is adapted for substantially enclosing and containing the bale of compressed, resilient fibers. Mushroom and loop fasteners are located along an edge portion of each piece and are adapted for joining the pieces to one another. Uncompressed, resilient fibers are provided. A portion of the uncompressed, resilient fibers are surrounded with the kit. Those fibers are compressed, and the mushroom and loop fasteners are engaged.

U.S. Pat. No. 4,157,754 discloses compressed that fibers, filaments, or cabled tows, which are under an internal pressure of at least 0.2 daN/cm2, are packaged by means of an outer wrapping, an the overlapping areas of the wrapping are held together by means of an adhesive, for instance a neoprene-chloroprene-rubber based adhesive. In this manner, it is possible to eliminate straps, belts or wires which have been conventionally used to hold the package. As shown in FIG. 1, the adhesive is a glue that is applied to the entire overlap area.

GB 1512804 claims a method of preparing and packaging fodder comprising the steps of partially wilting green herbage, inserting a compacted block thereof into a bag or wrapper of impermeable plastics material, hermetically sealing the bag or wrapper against ingress of air and, before or after sealing, providing a non-return valve to allow the contents to exhaust to atmosphere.

AU737531 discloses a multi-layer plastics packaging in the form of a bag for packaging bales of wool, a bag being sealed at one end to form a substantially square bottom for the bale. The structure of the multi-layer coextruded film employed to manufacture the wool bag is carefully designed to obtain the necessary mechanical properties required to withstand the rough handling of wool bales during transportation and storage. The multi-layer film comprises a first layer of high stiffness plastics material forming a core or intermediate layer of the multi-layer film, and second and third layers of high strength plastics material. The desired physical characteristics or mechanical properties of the multi-layer film are achieved using a blend of various density polyethylene plastics materials in each of the first, second and third layers.

AU3302184 claims a woolpack comprising a bag of a non-woven sheet material closed at one end by multiple closure elements disposed to shape a broadly rectangular bottom for the bag when expanded, and closure flaps for closing the other end of the bag. The bag is in the form of a tub flattened into a four layer configuration comprising opposed outer layers which act to sandwich therebetween two folded side gussets of substantially similar width, each gusset extending inwardly from a respective longitudinal edge of the flattened tube with the inner edges of the two gussets extending substantially along the longitudinal centre line of the flattened tube. The multiple closure elements comprise respective mitre seals which connect each layer of each gusset to the adjacent outer layer. Each mitre seal extends diagonally from the centre region of a bottom transverse edge of the tube to a respective longitudinal edge of the tube. The four layers are connected by a further seal which extends across the bottom transverse edge, the arrangement being such that in the expanded bag the four mitre seals each extend from a centre region of said broadly rectangular bottom to the corner portions of said substantially rectangular bottom.

However, these existing packaging methods are complicated, expensive, and may be dangerous. For example, a strap under high pressure may snap during storage or may spring back during opening. Vacuum sealing and heat sealing require additional equipment and the seal must be sufficiently strong to maintain the vacuum or air-tight conditions during storage. Thus, the need exists for improved methods for packaging fibrous material, especially for packaging cellulose acetate tow bales, that are cost effective, uncomplicated, and sufficiently robust so as to withstand the internal pressure of the fibrous material.

SUMMARY OF THE INVENTION

The present invention is directed to a method for packaging a fibrous material, comprising: (a) placing a fibrous material between at least an upper sheet and a lower sheet, wherein the surface area of the upper sheet is greater than the surface area of the upper surface of the fibrous material and wherein the surface area of the lower sheet is greater than the surface area of the lower surface of the fibrous material; (b) folding a portion of the lower sheet on opposing sides of the fibrous material to form lower folds along opposing edges of the opposing sides; (c) folding a portion of the upper sheet on the opposing sides of the fibrous material to form upper folds along opposing edges of the opposing sides; and (d) applying a perimeter pass of tape comprising an adhesive layer to connect the upper sheet and the lower sheet. The tape surface area may be at least 5% of the side surface area of the fibrous material, or may range from 5 to 80% of the side surface area of the fibrous material. In some aspects, the fibrous material is a compressed cellulose acetate tow bale. In some aspects, the upper sheet overlaps the lower sheet on each side of the fibrous material. In other aspects, the lower sheet overlaps the upper sheet on each side of the fibrous material. The upper sheet and lower sheet may have a thickness from 100 to 800 μm. The method may further comprise removing air bubbles from under the tape after applied to the overlap. Steps (a) through (d) may be conducted at ambient temperature and pressure. In some aspects, the tape may be substantially free of reinforcing fibers. In preferred embodiments, straps are not required to restrain expansion of the fibrous material, although in some embodiments such straps may be employed. The tape may have a tensile strength from 10 to 175 N/cm. In some aspects, the tensile strength of the tape may be at least 87 N/cm. The tape may have a shear strength from 0.5 to 10 N/cm2. In some aspects, the shear strength of the tape may be at least 4 N/cm2. The lower sheet and the upper sheet may overlap by at least 5% in a lateral direction. The lower folds and upper folds may be under folds. The packaged fibrous material may have substantially flat sides. In some aspects, the top and bottom of the packaged material may also be substantially flat and the packaged fibrous material may be stacked on its sides or on its top and bottom. In other aspects, the top and bottom of the packaged material may be convex or concave and in these aspects, the packaged fibrous material may be stacked on its side. The lower sheet and the upper sheet may be selected from the group consisting of cardboard, polyethylene, polypropylene, polybutylene, copolymers thereof and combinations thereof. The lower sheet and the upper sheet may be woven, coated, knitted, and/or multilayer films. In some aspects, the upper folds and lower folds are secured, optionally temporarily, with a fold tape prior to step (d) and wherein the fold tape is a separate piece of tape, of same or different material, than the tape of step (d). The fibrous material of step (a) may comprise a non-sealed liner that separates the fibrous material from the upper and the lower sheets. The surface area of the upper sheet may be substantially similar to the surface area of the lower sheet. The fibrous material may be compressed prior to step (a). Step (a) may further comprise compressing the fibrous material.

In a second embodiment, the present invention is directed to a method for packaging a fibrous material comprising: securing an upper sheet and a lower sheet to the fibrous material with a perimeter pass of tape, wherein the upper sheet and the lower sheet overlap along the sides of the fibrous material and further wherein at least a portion of the upper sheet and the lower sheet are under folded to provide a packaged fibrous material having substantially flat sides. In some aspects, the fibrous material is a compressed cellulose acetate tow bale.

In a third embodiment, the present invention is directed to a method for packaging a fibrous material comprising: securing an upper sheet and a lower sheet with a perimeter pass of tape, wherein the upper sheet and the lower sheet overlap along the sides of the fibrous material and further wherein the tape surface area is at least 5% of the side surface area of the fibrous material. In some aspects, the fibrous material is a compressed cellulose acetate tow bale.

In a fourth embodiment, the present invention is directed to a method for packaging a fibrous material comprising adhering two opposing sheets with a perimeter pass of tape at ambient temperature. In some aspects, the fibrous material is a compressed cellulose acetate tow bale.

BRIEF DESCRIPTION OF THE DRAWING

The present invention will be better understood in view of the appended non-limiting figures, in which.

DETAILED DESCRIPTION OF THE INVENTION

Introduction

Figure 1:
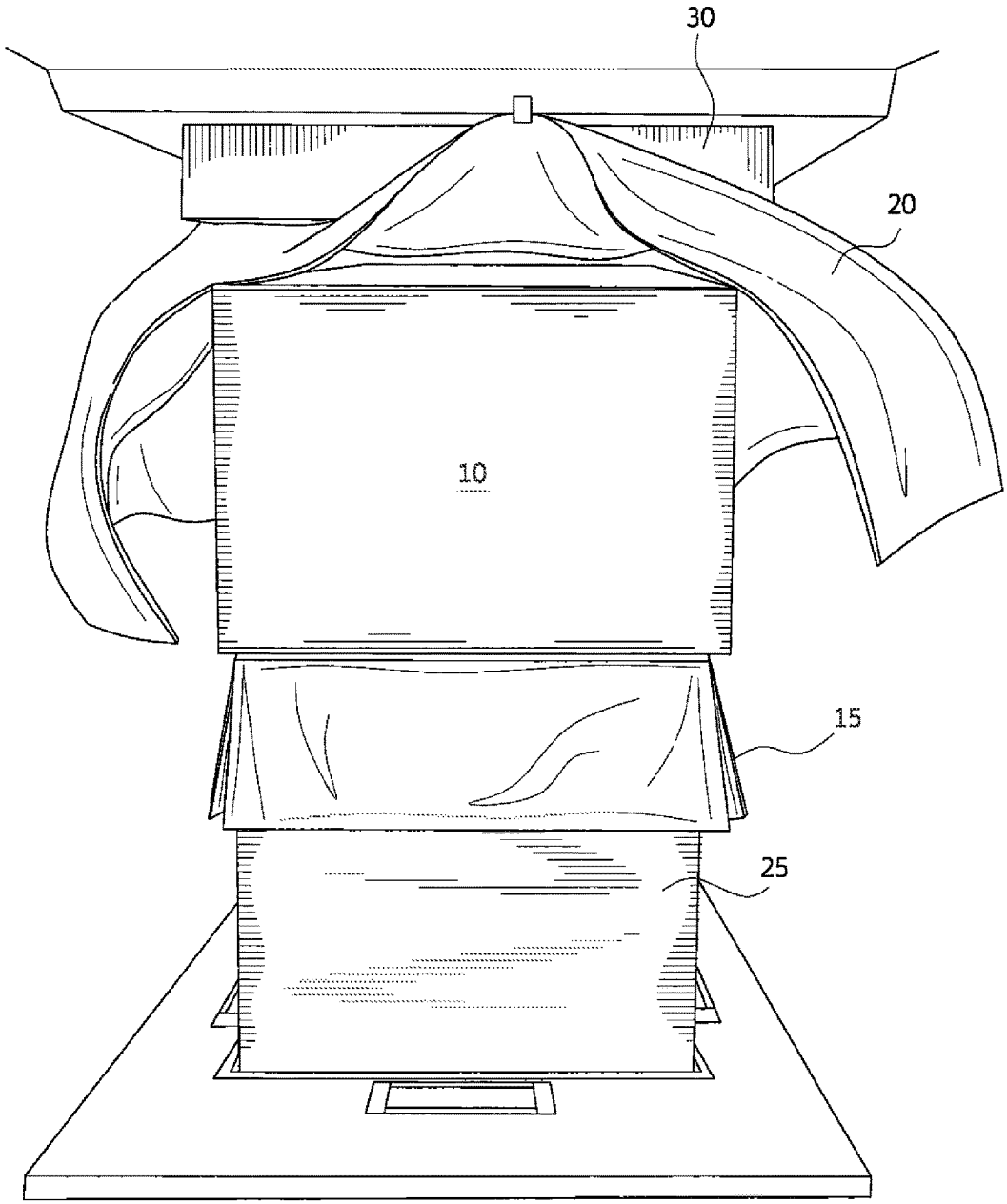
FIG. 1 shows a cellulose acetate tow bale prepared for packaging in accordance with an embodiment of the invention.

The present invention relates to methods for packaging a fibrous material. In one embodiment, the method comprises placing a fibrous material, preferably while in a compressed cubic form (a bale), between at least an upper sheet and a lower sheet, folding a portion of the lower sheet on opposing sides of the fibrous material, folding a portion of the upper sheet on opposing sides of the fibrous material, and applying a perimeter pass of tape comprising an adhesive layer to connect the upper sheet and the lower sheet. The surface area of the upper sheet is greater than the surface area of the upper surface of the fibrous material and the surface area of the lower sheet is greater than the surface area of the lower surface of the fibrous material. In some aspects, the lower sheet is folded first and the upper sheet overlaps the lower sheet on each side of the fibrous material. In other aspects, the upper sheet is folded first and overlaps the lower sheet on each side of the fibrous material.

The surface areas of the upper and lower sheets, respectively, are preferably greater than the surface area of the fibrous material being covered thereby. To account for this difference in surface area, excess material in each sheet is preferably folded, optionally in a triangle-shaped fold, along the longitudinal side edges of the fibrous material and may be tucked underneath the sheet in an "under fold" or alternatively folded over the sheet in an "over fold." The resulting edge folds provide increased sheet material along the sides of the packaged fibrous material beneficially resulting in increased strength and reducing the likelihood of premature sheet tearing.

The tape used to connect the upper sheet and the lower sheet preferably has a surface area that is at least 5% of the side surface area of the fibrous material, more preferably at least 10% and more preferably at least 40%. In terms of ranges, the tape preferably has a surface area from 5 to 80% of the side surface area of the fibrous material, preferably from 10 to 75%, and most preferably from 25 to 75%. Each of the upper and lower sheets may have a thickness from 100 to 800 μm, preferably from 200 to 500 μm, more preferably from 300 to 400 μm. The upper and lower sheets may each be comprised of a material selected from the group consisting of cardboard, polyethylene, polypropylene, polybutylene, copolymers thereof and combinations thereof. The material may be woven or knitted, reinforced or non-reinforced, and may also be coated. In some aspects, the upper and lower sheets may each be a multilayer film.

In another embodiment, the method for packaging a fibrous material comprises securing an upper sheet and a lower sheet with a longitudinally-extending perimeter passes of a tape, wherein the upper sheet and the lower sheet overlap along the sides of the fibrous material and further wherein the tape surface area is at least 5% of the side surface area of the fibrous material. Optionally a plurality of perimeter tapes, of the same or different type, may be used in the perimeter passes to secure the upper sheet to the lower sheet.

In yet another embodiment, the method for packaging a fibrous material comprises adhering two opposing sheets with a perimeter pass of tape at ambient temperature.

The packaging method of the present invention is advantageously able to withstand the internal pressure of the fibrous material without the need for heat sealing, vacuum sealing, straps, or other closing materials or measures. Thus, the present invention advantageously achieves an uncomplicated and cost efficient method of packaging a fibrous material that is suitable for storage and shipment.

Opening of the packaged fibrous material may be achieved, for example, by cutting along one perimeter tape in a lateral direction, and cutting the sheets along the longitudinally-extending side edges. The expansive force of the fibrous material preferably facilitates the cutting process. The cutting may be achieved with a cutting device which preferably cuts the tape without cutting the sheets, such as safety knives, letter openers, and other known cutting devices.

Fibrous Materials

As described herein, the present invention is applicable to methods for packaging fibrous materials. The fibrous material may be any fibrous material that is packaged for use, storage and/or shipment. In some embodiments, the fibrous material may be selected from the group consisting of polyester, polypropylene, polyethylene, olefins, and other polymeric materials. In some embodiments, the fibrous material may be a grass or hay such as timothy hay, alfalfa hay, orchard grass hay, Bermuda grass hay, oat hay, clover hay, grass hay, fescue hay and tall fescue hay. In still further embodiments, the fibrous material may be selected from the group consisting of cotton, fiberglass insulation, beet pulp, and wood shavings. In preferred embodiments, as indicated, the fibrous material comprises, consists essentially of, or consists of cellulose acetate, preferably cellulose acetate tow, which is typically compressed to form a bale prior to packaging. Methods for preparing and baling cellulose acetate tow are disclosed in U.S. Pat. Nos. 7,610,852; 7,585,442; 7,585,441; 8,308,624; 6,924,029 and 7,487,720, the entireties of which are incorporated herein by reference.

The fibrous material may be compressed or otherwise compacted prior to packaging. Compression during packaging may reduce the volume of the fibrous material by at least 10%, preferably at least 25% or more preferably at least 40%. In terms of ranges, the volume of the fibrous material may be reduced by compression from 10 to 80%, preferably from 25 to 75% or from 40 to 70%. Flammability of the fibrous material may be considered when determining the amount of compression, particularly for a fibrous material having a low ignition temperature, such as hay. In some aspects, the fibrous material, e.g., cellulose acetate tow, may be compressed by at least 40%, preferably at least 60%, or more preferably at least 70%.

After compression but prior to securing the packaging with tape, the platens may be retracted or opened by a small amount. This retraction step may result in a volume increase less than 20%, e.g., less than 15% or less than 10%, optionally from 0.5 to 15%. After opening the platens to release the packaged bale, the resulting packaged fibrous material may be allowed to further expand, causing a limited degree of stretching of the upper and lower sheets and/or the tape, optionally resulting in a volume increase less than 20%, e.g., less than 15% or less than 10%, optionally from 1 to 15%, e.g., from 1 to 10%, calculated based on the volume or height difference at the time packaging has been completed to a time that expansion has substantially ceased.

Upper and Lower Sheets

The upper and lower sheets may be comprised of the same or different material. The sheets are flexible and may be made from a textile, film or foil, such as a single layer extruded film or a multi-layer extruded film. The film or foil may comprise one or more of paper, polymers or metals. In one aspect, the upper and lower sheets comprise cardboard. In another aspect, the either or both sheets comprise polymer film or foil. The polymer film or foil may comprise ethylene/vinyl acetate copolymer, polyvinylidene chloride, polyethylene homopolymer, polypropylene homopolymer, ethylene/alpha-olefin copolymer, polyvinyl chloride, polyamide, polyester, and polystyrene. The polyethylene film may be a long-chain-low-density polyethylene film.

In some aspects, the sheets may be formed from woven or woven and coated polyester, polypropylene, polyethylene, scrims, and other fiber reinforced films.

The sheets may further comprise modifiers, pigments, processing aids, anti-stats, and other additives to modify the properties of the layer. For example, the film may be liquid impermeable, vapor impermeable, or both. Each sheet may be one continuous sheet, containing no seams or perforations. In some embodiments, the sheets may comprise a fiber or string reinforced polymer film.

The sheets may be transparent, translucent or opaque, or may be a variety of colors. In one aspect, the film is black. In another aspect, the sheets are clear.

The sheets may have a thickness from 100 to 800 μm, preferably from 200 to 600 μm or more preferably from 300 to 400 μm. The sheets may have a tensile strength from 10 to 175 N per cm of width in both the machine and x-machine directions, preferably a minimum from 17 to 131 N/cm of width, more preferably a minimum from 43 to 87 N/cm of width. In some aspects, the sheets may have a tensile strength of approximately 87 N/cm of width. In order to maintain the desired final tow bale package height and volume, elongation of the sheets should not be excessive and may range from 1 to 20%, preferably from 1 to 10% in the load working range above.

Tape

The tape comprising a substantially planar substrate (optionally rolled in a tape roll) having adhesive on a surface thereof may be any tape that is sufficiently strong to withstand the expansive forces of the fibrous material without tearing or having excessive elongation causing excessive expansion after packaging as indicated above. When the fibrous material is a cellulose acetate tow bale, the forces on the tape may range from 10 to 175 N/cm, e.g., from 17 to 131 N/cm, from 43 to 87 N/cm, or up to 87 N/cm.

The tape may be selected to satisfy certain tensile strength, e.g., tensile load requirements and/or constant shear loads. The tensile load requirement is measured in Newtons (N) per centimeter (cm) of width in the cross-machine or primary load direction and may be measured according to ASTM D3759 or PSTC-131, incorporated herein by reference in their entireties. The tape may be able to withstand a tensile load from 10 to 175 N/cm, preferably from 17 to 131 N/cm, more preferably from 43 to 87 N/cm. In another aspect, the tape may be able to withstand a tensile load of at least 87 N/cm. Suitable tapes are described, for example, in U.S. Pub. No. 2014/0004765, EP 2631278A1, WO2013/037648A2, and WO2012/150099A1, the entireties of which are incorporated herein by reference.

The constant shear load is measured in kilograms per square centimeter and may be measured using ASTM 6463-99, procedure A, the entirety of which is incorporated herein by reference. The testing is conducted with the desired weights and the tape is capable of withstanding the constant shear load if it does not fail after 3000 minutes. Fail is defined as slipping or separation of the tape prior to 3000 minutes. The tape may be able to withstand a constant shear load from 0.5 N/cm2 to 10 N/cm2, preferably 0.6 N/cm2 to 7 N/cm2, more preferably from 2 to 6 N/cm2, most preferably from 4 to 6 N/cm2. In another aspect, the tape may be able to withstand a constant shear load of at least 4 N/cm2.

Other properties of the tape may also be considered when selecting a tape for the inventive method, including, tear strength, bond strength, viscosity, glass transition temperatures, elongation at break, peel strength and softening points. The tape may have a peel strength, the ability of the tape to resist forces that may pull it apart, sufficient to allow for ease of handling. The peel strength may be high enough for handling and tape application but lower than the forces requires to tear or cut the tape. The peel strength may be controlled by adjusting the tacking strength of the tape. In some aspects, the tape may have a peel strength of at least 2.7 N/cm, preferably at least 4.3 N/cm as disclosed in U.S. Pub. 2013/0233485, the entirety of which is hereby incorporated by reference. The peel force of the tape may depending on the width of the tape and the type of carrier used. The tape may have sufficient elongation to allow for ease of handling. In some embodiments, the tape may have an elongation from 1% to 25%, preferably from 1% to 15%, more preferably from 5% to 15%.

The tape may comprise a substrate or carrier, such as a paper, a laminate, a film, a foam or a foamed film. The film may be comprised of polyethylene, polyethylene terphthalate, polypropylene, polyester, polyamide (including nylon-6, nylon-6,6, nylon-6,9, nylon-6,10, nylon 6,12, nylon-11, and nylon-12), polyurethane, mixtures thereof, and copolymers thereof. The film may be mono- or biaxially oriented. The carrier may also comprise a textile carrier such as knitted fabrics, scrims, tapes, braids, tufted textiles, felts, woven materials (including plain weave, twill and satin weave), reinforced fabric, warp knits and nonwoven webs (including consolidated staple fibre webs, filament webs, meltblown webs, and spunbonded webs).

The adhesive may be a pressure-sensitive adhesive, e.g., a viscoelastic composition which, in the dry state at room temperature, remains permanently tacky and adhesive. Bonding is accomplished under gentle applied pressure instantaneously to virtually all substrates. Pressure-sensitive adhesives employed include those based on block copolymers containing polymer blocks. These blocks are formed preferably of vinylaromatics (A blocks) such as styrene, for example, and those through polymerization of 1,3-dienes (B blocks), such as, for example, butadiene and isoprene or a copolymer of the two. Mixtures of different block copolymers can also be employed. Preference is given to using products which are partly or fully hydrogenated. The block copolymers may have a linear A-B-A structure. It is likewise possible to employ block copolymers with radial architecture, and also star-shaped and linear multiblock copolymers. In place of the polystyrene blocks it is also possible to utilize polymer blocks based on other aromatics-containing homopolymers and copolymers (preferably C8 to C12 aromatics), having glass transition temperatures, for example, of greater than about 75° C., such as, for example, α-methylstyrene-containing aromatics blocks.

Also utilizable are polymer blocks based on (meth)acrylate homopolymers and (meth)acrylate copolymers with glass transition temperatures of greater than 75° C. In this context it is possible to employ not only block copolymers which as hard blocks utilize exclusively those based on (meth)acrylate polymers, but also those which utilize not only polyaromatics blocks, polystyrene blocks for example, but also poly(meth)acrylate blocks. The figures for the glass transition temperature for materials which are not inorganic and not predominantly inorganic, more particularly for organic and polymeric materials, relate to the glass transition temperature figure Tg in accordance with DIN 53765:1994-03 (cf. section 2.2.1), incorporated herein by reference, unless indicated otherwise in the specific case. In place of styrene-butadiene block copolymers and styrene-isoprene block copolymers and/or their hydrogenation products, including styrene-ethylene/butylene block copolymers and styrene-ethylene/propylene block copolymers, it is likewise possible in accordance with the invention to utilize block copolymers and their hydrogenation products which utilize further polydiene-containing elastomer blocks such as, for example, copolymers of two or more different 1,3-dienes. Functionalized block copolymers such as, for example, maleic anhydride-modified or silane-modified styrene block copolymers may also be used. Typical use concentrations for the block copolymer lie at a concentration in the range from 30 wt. % to 70 wt. %, more particularly in the range from 35 wt. % to 55 wt. %.

Further polymers that may be included in the tape are those based on pure hydrocarbons such as, for example, unsaturated polydienes, such as natural or synthetically produced polyisoprene or polybutadiene, elastomers with substantial chemical saturation, such as, for example, saturated ethylene-propylene copolymers, α-olefin copolymers, polyisobutylene, butyl rubber, ethylene-propylene rubber, and also chemically functionalized hydrocarbons such as, for example, halogen-containing, acrylate-containing, or vinyl ether-containing polyolefins, which may replace up to half of the vinylaromatics-containing block copolymers.

The tape may further comprise a tackifier or tackifier resin. Suitable tackifier resins include partially or fully hydrogenated resins based on rosin or on rosin derivatives. It is also possible at least in part to employ hydrogenated hydrocarbon resins, examples being hydrogenated hydrocarbon resins obtained by partial or complete hydrogenation of aromatics-containing hydrocarbon resins (for example, Arkon P and Arkon M series from Arakawa, or Regalite series from Eastman), hydrocarbon resins based on hydrogenated dicyclopentadiene polymers (for example, Escorez 5300 series from Exxon), hydrocarbon resins based on hydrogenated C5/C9 resins (Escorez 5600 series from Exxon), or hydrocarbon resins based on hydrogenated C5 resins (Eastotac from Eastman), and/or mixtures thereof. Hydrogenated polyterpene resins based on polyterpenes can also be used. The tackifier resins may be employed both alone and in a mixture.

The tape may also comprise further additives, including light stabilizers such as UV absorbers, sterically hindered amines, antiozonants, metal deactivators, processing assistants, and endblock-reinforcing resins. Plasticizers may include liquid resins, plasticizer oils, or low molecular mass liquid polymers (including low molecular mass polyisobutylenes with molar masses less than 1500 g/mol (numerical average) or liquid EPDM grades).

The tape may have a liner material, with which the one or two layers of adhesive are lined up until use. Suitable liner materials include all of the materials listed comprehensively above. Preference, however, is given to using a nonlinting material such as a polymeric film or a well-sized, long-fiber paper.

A release agent may have been applied to the top face of the carrier or film. Suitable release agents include surfactant-based release systems based on long-chain alkyl groups such as stearyl sulfosuccinates or stearyl sulfosuccinamates, but also polymers, which may be selected from the group consisting of polyvinylstearyl carbamates, polyethyleneimine stearylcarbamides, chromium complexes of C14-C28 fatty acids, and stearyl copolymers, as described for example in DE 28 45 541 A, incorporated herein by reference in its entirety. Likewise suitable are release agents based on acrylic polymers with perfluorinated alkyl groups, silicones or fluorosilicone compounds, such as those based on poly(dimethylsiloxanes), for example. The release coat may comprise a silicone-based polymer. Particularly preferred examples of such silicone-based polymers with release effect include polyurethane- and/or polyurea-modified silicones, preferably organopolysiloxane/polyurea/polyurethane block copolymers, more preferably those as described in example 19 of EP 1336683B1, the entirety of which is incorporated herein by reference, including anionically stabilized, polyurethane- and urea-modified silicones having a silicone weight fraction of 70% and an acid number of 30 mg KOH/g. In one embodiment, the release layer comprises 10 to 20 wt %, more preferably 13 to 18 wt %, of the release-effect constituent.

Prior to packaging, the tape may be provided in the form of a roll, in other words in the form of an Archimedean spiral wound up onto itself, or with lining with release materials such as siliconized paper or siliconized film on the adhesive side. The reverse face of the adhesive tape may carry an applied reverse-face varnish in order to beneficially influence the unwind properties of the adhesive tape wound in the roll.

The tape may comprise reinforcements consisting of bidirectional laid/woven fabrics made from PET yarns or strings with low stretchability. In particular, warp knits with weft threads are suitable, since the lack of the corrugated structure of the warp thread in the case of laid fabrics means that no additional stretchability is introduced into the material. In other embodiments, the tape is free of reinforcing string or fibers.

The width of the tape may be selected depending on its tensile strength, shear strength, and the load requirements of the final application. As described above, for cellulose acetate tow application and tape in the described preferred strength ranges, the width of the tape is at least 5% of the side surface area of the fibrous material, preferably at least 10% and more preferably at least 25%. In terms of ranges, the width of the tape is selected to provide a tape having a surface area from 5 to 80%, preferably from 10 to 75%, and most preferably from 25 to 50% of the side surface area of the fibrous material. The thickness of the tape may also be selected depending on the application as well as the desired tensile strength and shear strength of the tape. Although the thickness of the tape may vary, it preferably ranges from 50 to 400 μm, e.g., from 75 to 200 μm or 100 to 150 μm.

Packaging Methods

As described herein, the inventive method relates to packaging of a fibrous material, e.g., cellulose acetate tow. The fibrous material may be compressed prior to being packaged. The uncompressed fibrous material may be provided in any shape, e.g., cube, rectangular prism, cylinder, etc., preferably a rectangular prism. In further aspects, the uncompressed fibrous material may be provided in a liner, e.g. a liner between the fibrous material and the sheets, to inhibit odor or water infiltration, or other types of contamination. If used, the liner is preferably not used to contain any degree of compression of the fibrous material. The liner may be any conventional liner known in the art, including a liner made of the same material as the lower sheet and/or upper sheet. The liner is not heat or vacuum sealed and accordingly is not air-tight.

Prior to packaging, the fibrous material may be stored in a large can, which serves to contain the fibrous material under atmospheric pressure. The can may be opened to provide the shaped fibrous material. The fibrous material may be compressed through known methods so as to form a cubic or rectangular prism-shaped compressed fibrous material. As shown in FIG. 1, fibrous material 10 has been provided in a rectangular prism shape. Fibrous material 10 is placed between lower sheet 15 and upper sheet 20 before or after compression. As shown, lower sheet 15 rests on lower platen 25 and upper sheet 20 is removably attached or unattached to upper platen 30. Each sheet may be attached to its respective platen by known means, including magnets, tape, rope, bungee cord, or other securing means. The surface area of lower sheet 15 and of upper sheet 20 is larger than the top surface area and bottom surface area of fibrous material 10, respectively. The sheet size is chosen to provide for enough material that, when folded, completely covers fibrous material 10.

Once the uncompressed fibrous material is placed between lower sheet 15 and upper sheet 20, the press may be activated to enclose the fibrous material and either raise lower platen 25 or lower upper platen 30 to compress fibrous material 10. A target force is applied for a pre-determined dwell time to compress fibrous material 10. The dwell time may range from 0.1 to 10 minutes, preferably from 0.1 to 5 minutes or more preferably from 0.1 to 2.5 minutes. The target force applied may range from 45 to 455 metric tonnes. After compression, a certain percentage of retraction and relaxation is permitted, as described above. The compressed fibrous material contains residual force that is maintained in the compressed fibrous material after the platens have been retracted but prior to securing the upper and lower sheets with tape. In embodiments where the compressed fibrous material is a cellulose acetate tow bale, the residual force may be up to about 35 N/cm2. Once the packaging is secured with the tape and the press is opened to release the packaged compressed fibrous material, the package may expand vertically, and possibly laterally, as the fibrous material fills the package, causing the packaging materials to stretch. When the packaging materials stretch, the compressive force in the fibrous material drops, but may still be up to about 5 N/cm2.

The compressive force may remain in this range for approximately 48 hours. It may be gradually reduced after this time.

In some aspects (not shown), fibrous material 10 has been compressed prior to being placed between lower sheet 15 and upper sheet 20. In these aspects, lower platen 25 and upper platen 30 are not necessary and the sheets may be manually placed over fibrous material 10.

Once the fibrous material has been compressed, either prior to being placed between lower sheet 15 and upper sheet 20, or after placing, the packaging is conducted preferably at ambient temperature and pressure.

Figure 2:
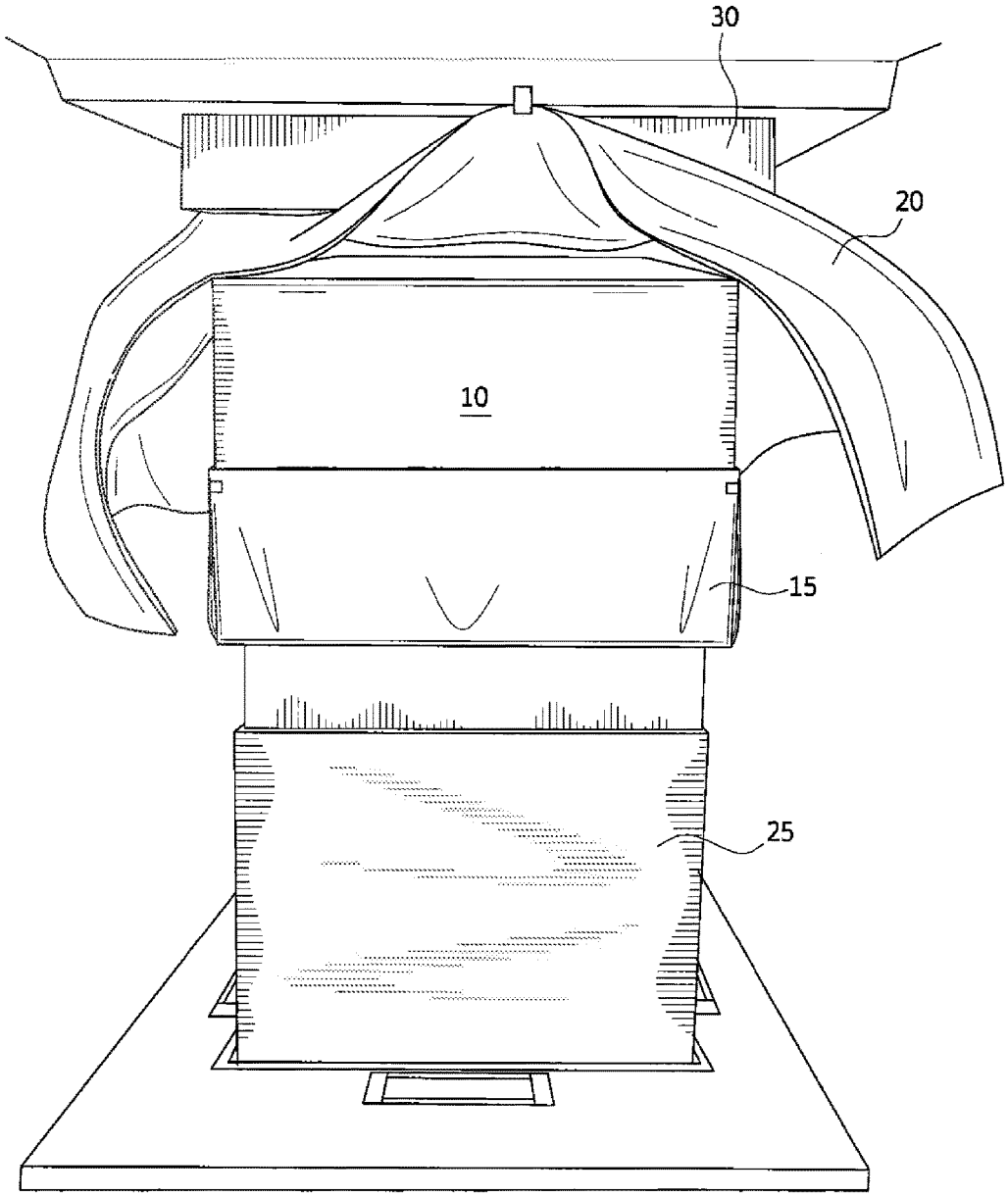
FIG. 2 shows a cellulose acetate tow bale with a folded lower sheet in accordance with an embodiment of the invention.

As shown in FIG. 2, lower sheet 15 is folded up and around fibrous material 10. Lower sheet 15 is folded along each corner of the lower portion of fibrous material 10. As shown, the folds in lower sheet 15 are under folds, meaning that the excess material of lower sheet 15 is between the flat outer portion of lower sheet 15 and fibrous material 10, as shown. The folds may be secured by any known securing means, including tape, e.g., duct tape or masking tape. In some aspects, the folds may be secured by a clear baling tape. The securing means may be the tape disclosed herein. However, the securing means need not meet the strength requirements of the tape disclosed herein since the securing means are a temporary way to hold the folds in place until the perimeter tape is applied.

Figure 3:
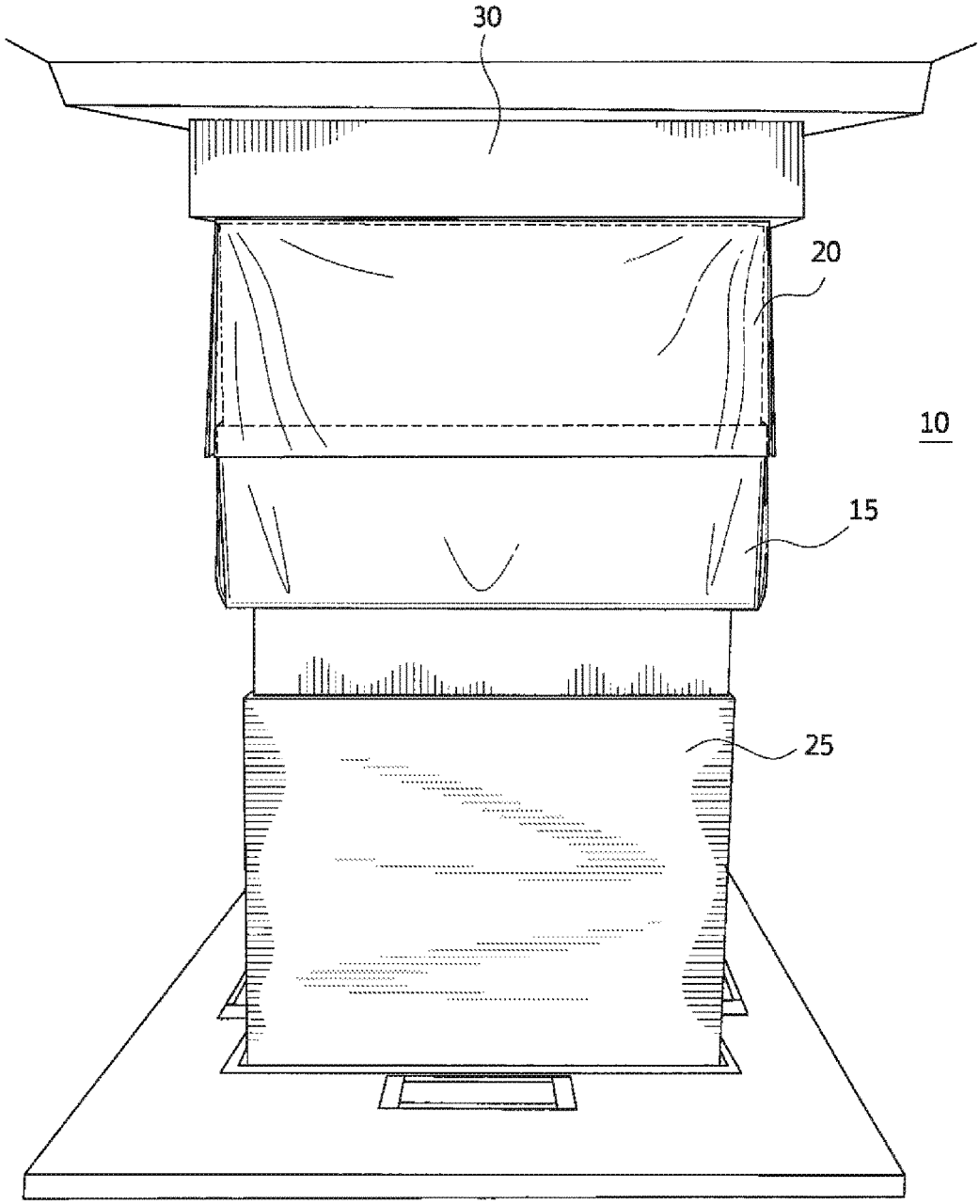
FIG. 3 shows a cellulose acetate tow bale with a folded upper sheet in accordance with an embodiment of the invention.

Upper sheet 20 is then folded around fibrous material 10 as shown in FIG. 3. In this aspect, lower sheet 15 is folded before upper sheet 20, and thus upper sheet 20 overlaps lower sheet 15 as indicated by the hashed line in FIG. 3. A securing means as described with regard to lower sheet 15 may be similarly used to secure the folds of upper sheet 20. As shown, the folds of upper sheet 20 are under folds as described herein.

The amount of overlap between lower sheet 15 and upper sheet 20 may be at least 5% of the total height of the compressed bale in a longitudinal direction, preferably at least 7.5% and more preferably at least 10%. In terms of ranges, the overlap between lower sheet 15 and upper sheet 20 may range from 1 to 40% of the total height of the compressed bale in a longitudinal direction, preferably from 1 to 25%, more preferably from 5 to 15%, most preferably from 7.5 to 10%. As used herein, longitudinal refers to a direction normal to the ground, and lateral refers to a direction parallel to the ground.

In other aspects (not shown), upper sheet 20 may be folded first and lower sheet 15 may overlap upper sheet 20. The configuration in FIG. 3 may be preferred due to the improved water and contaminant resistance of this configuration.

Figure 4:
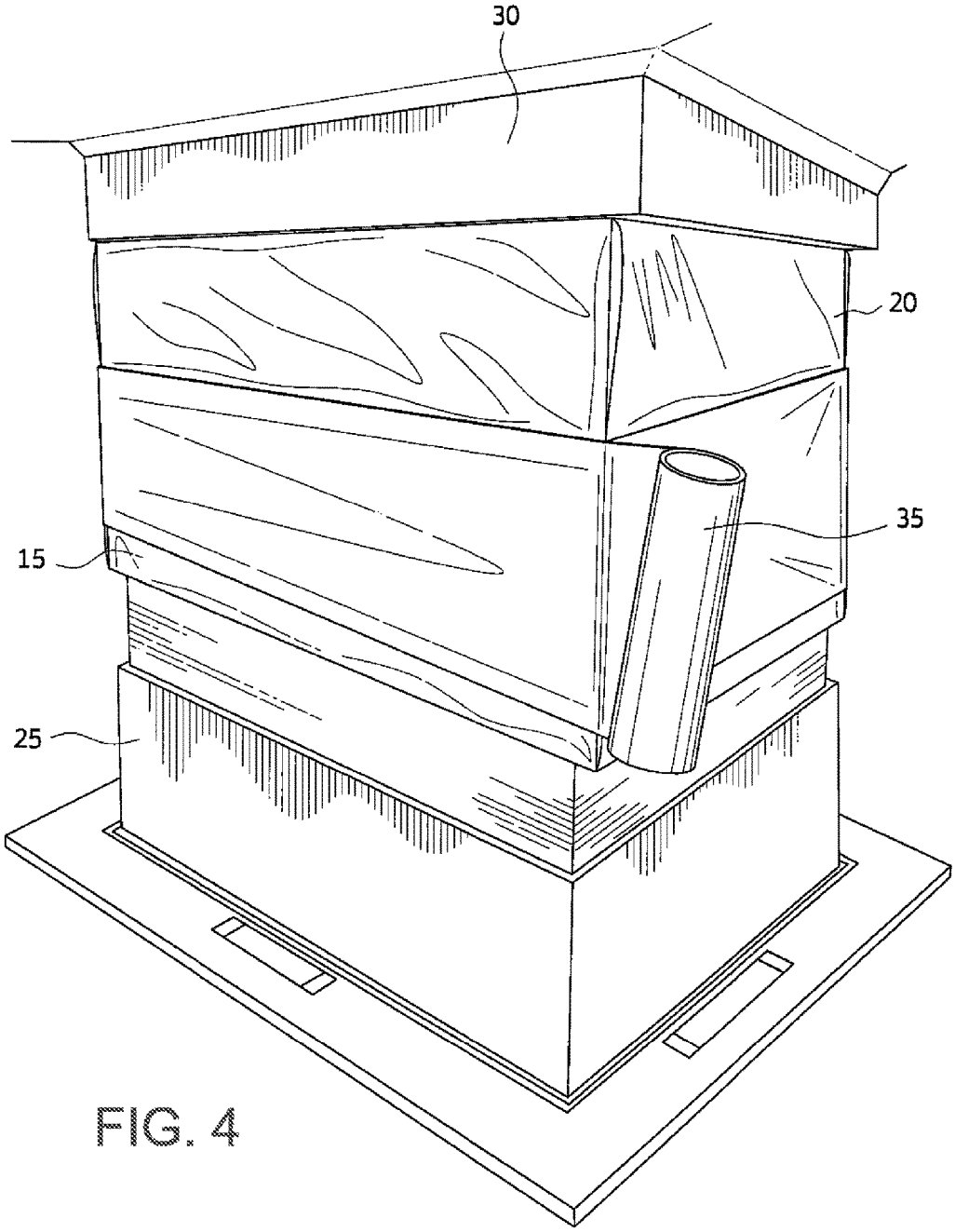
FIG. 4 shows a cellulose acetate tow bale with tape applied in accordance with an embodiment of the invention.

After lower sheet 15 and upper sheet 20 have been folded, tape 35 may be applied. As shown in FIG. 4, the tape is applied to cover the overlap between lower sheet 15 and upper sheet 20. The width of the tape is preferably selected based on its tensile strength, shear strength, and final application requirements. For a cellulose acetate tow bale, the tape surface area is at least 10% of the side surface area of the fibrous material, preferably at least 25% and more preferably at least 40%. In terms of ranges, the tape preferably has a surface area from 10 to 80% of the side surface area of the fibrous material, preferably from 25 to 75%, and most preferably from 30 to 50%. The tape is selected as described herein, to meet tensile strength and constant shear load requirements. Thus, the tape is able to withstand the internal expansion pressure placed upon it by the compressed fibrous material. Tape 35 may be applied in a single perimeter pass or may be applied so that it overlaps itself. The tape may be applied manually or automatically.

After the tape is applied, it may be smoothed automatically or manually to remove air bubbles under the tape. However, the packaging method does not include any type of sealing of the sheets or tape, and preferably no straps are applied to restrain or contain the package. The finished packaged fibrous material is not air-tight and does not have any air-tight joints.

Figure 5:
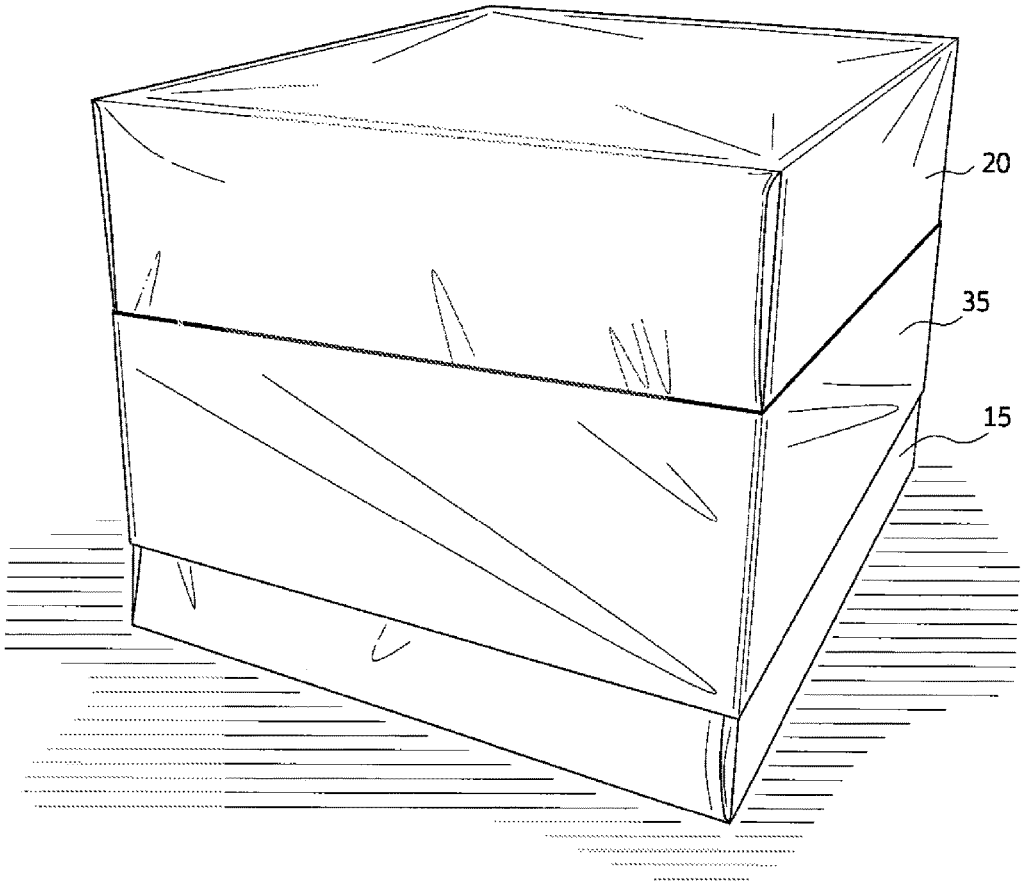
FIG. 5 shows a packaged cellulose acetate tow bale in accordance with an embodiment of the invention.

The finished packaged fibrous material is shown in FIG. 5. The finished packaged fibrous material preferably has substantially flat sides, rendering it suitable for stacking during storage and/or shipping.

In another embodiment, the packaging method may be used as described herein, but with additional sheets. For example, instead of overlapping the upper sheet and lower sheet, a third sheet, or even additional sheets may be applied around the perimeter of the fibrous material to provide an overlap. In yet another embodiment, the packaging method may use only one sheet, which is folded on one surface of the fibrous material and the folds are secured in place with the tape described herein. In still another embodiment, more than one layer of sheets and tape may be applied.

Although the fibrous material disclosed in the Figures is shown in a cube shape, it is understood that other shapes may be used and the folding process modified accordingly to allow for the sheets to overlap and be connected with a perimeter tape.

The present invention will be better understood in view of the following non-limiting examples.

EXAMPLES

Example 1

A press comprising an upper platen and a lower platen was provided. The upper platen was rolled aside. A lower platen was then raised from the floor and the lower sheet was secured to the upper surface of a lower platen using magnets. A can of cellulose acetate tow was set above the lower platen and the bottom of the can was opened. The lower platen was lowered into the floor until the cellulose acetate tow from the can was contained in the press box. The press box containing the tow and the lower platen were raised together and the upper sheet placed atop. The upper platen was then rolled into position and the press box containing the tow and the lower platen was raised to contact the upper platen. Then the compression of the cellulose acetate tow began. Pressing was maintained at a pressure of 345 metric tonnes for 2.5 minutes to form a cube of compressed cellulose acetate tow. Displaced air escaped around the platens. The lower platen was then lowered by 8% of the pressed height to reduce the force placed on the cellulose acetate tow bale, resulting in an internal pressure in the bale of approximately 27 metric tonnes.

The magnets were then removed from the lower sheet. The excess material of the lower sheet, e.g., the material larger than the bottom surface area of the fibrous material, was folded on opposing sides of the fibrous material, as shown in FIG. 2. The folds were secured with a clear tape. The excess material of the upper sheet was folded on opposing sides of the fibrous material, as shown in FIG. 3. The folds were secured with tape. The upper sheet overlapped the lower sheet in a longitudinal direction by 5%. A tape comprising polyethylene terphthalate, was wrapped around the perimeter of the fibrous material, to connect the upper sheet and lower sheet. The tape had a width of 42 cm and a tensile strength of at least 87 N/cm. The tape withstood a constant shear load of 4 N/cm2 for 3000 minutes, after which time the maximum forces had occurred and the bale internal forces were diminishing as the acetate fiber crept and relaxed. Air bubbles were removed from the tape by manually smoothing the tape against the sides of the fibrous material.

While the invention has been described in detail, modifications within the spirit and scope of the invention will be readily apparent to those of skill in the art. It should be understood that aspects of the invention and portions of various embodiments and various features recited herein and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention.

The following embodiments are also subject-matter of the present invention:

1. A method for packaging a fibrous material, comprising:
   a. placing a fibrous material between at least an upper sheet and a lower sheet, wherein the surface area of the upper sheet is greater than the surface area of the upper surface of the fibrous material and wherein the surface area of the lower sheet is greater than the surface area of the lower surface of the fibrous material;
   b. folding a portion of the lower sheet on opposing sides of the fibrous material to form lower folds along opposing edges of the opposing sides;
   c. folding a portion of the upper sheet on the opposing sides of the fibrous material to form upper folds along opposing edges of the opposing sides; and
   d. applying a perimeter pass of tape comprising an adhesive layer to connect the upper sheet and the lower sheet.
2. The method of embodiment 1, wherein the tape surface area is at least 5% of the side surface area of the fibrous material.
3. The method of claim 1, wherein the upper sheet overlaps the lower sheet on each side of the fibrous material.
4. The method of embodiment 1, wherein the lower sheet overlaps the upper sheet on each side of the fibrous material.
5. The method of embodiment 1, wherein the fibrous material is a compressed cellulose acetate tow bale.
6. The method of embodiment 1, wherein the tape surface area is from 5 to 80% of the side surface area of the fibrous material.
7. The method of embodiment 1, wherein the sheet has a thickness from 100 to 800 μm.
8. The method of embodiment 1, wherein the method further comprises removing air bubbles from under the tape after applied to the overlap.
9. The method of embodiment 1, wherein steps (a) through (d) are conducted at ambient temperature and pressure.
10. The method of embodiment 1, wherein the tape is substantially free of reinforcing fibers.
11. The method of embodiment 1, wherein the fibrous material is not restrained using straps.
12. The method of embodiment 1, wherein the tape has a tensile strength from 10 to 175 N/cm.
13. The method of embodiment 1, wherein the tape has a tensile strength of at least 87 N/cm.
14. The method of embodiment 1, wherein the tape has a shear strength from 0.5 $N/cm^2$ to 10 $N/cm^2$.
15. The method of embodiment 1, wherein the tape has a shear strength of at least 4 $N/cm^2$.
16. The method of embodiment 1, wherein the lower sheet and the upper sheet overlap by at least 5% in a longitudinal direction.
17. The method of embodiment 1, wherein the lower folds and upper folds are under folds.
18. The method of embodiment 1, wherein the packaged fibrous material has substantially flat sides.
19. The method of embodiment 1, wherein the lower sheet and the upper sheet are selected from the group consisting of cardboard, polyethylene, polypropylene, polybutylene, copolymers thereof and combinations thereof.
20. The method of embodiment 1, wherein the lower sheet and the upper sheet are woven.
21. The method of embodiment 1, wherein the lower sheet and the upper sheet are coated.
22. The method of embodiment 1, wherein the lower sheet and the upper sheet are knitted.
23. The method of embodiment 1, wherein the lower sheet and the upper sheet are multilayer films.
24. The method of embodiment 1, wherein the upper folds and lower folds are secured with a fold tape prior to step (d) and wherein the fold tape is a different tape than the tape of step (d).
25. The method of embodiment 1, wherein the fibrous material of step (a) comprises a non-sealed liner.
26. The method of embodiment 1, wherein the surface area of the upper sheet is substantially similar to the surface area of the lower sheet.
27. The method of embodiment 1, wherein the fibrous material is compressed prior to step (a).
28. The method of embodiment 1, wherein step (a) further comprises compressing the fibrous material.
29. A method for packaging a fibrous material, comprising securing an upper sheet and a lower sheet to the fibrous material with a perimeter pass of tape, wherein the upper sheet and the lower sheet overlap along the sides of the fibrous material and further wherein at least a portion of the upper sheet and the lower sheet are under folded to provide a packaged fibrous material having substantially flat sides.
30. The method of embodiment 29, wherein the fibrous material is a compressed cellulose acetate tow bale.
31. A method for packaging a fibrous material, comprising securing an upper sheet and a lower sheet with a perimeter pass of tape, wherein the upper sheet and the lower sheet overlap along the sides of the fibrous material and further wherein the tape surface area is at least 5% of the side surface area of the fibrous material.
32. The method of embodiment 31, wherein the fibrous material is a compressed cellulose acetate tow bale.
33. A method for packaging a fibrous material comprising adhering two opposing sheets with a perimeter pass of tape at ambient temperature.
34. The method of embodiment 33, wherein the fibrous material is a compressed cellulose acetate tow bale.

The invention claimed is:

1. A method for packaging a fibrous material, wherein the fibrous material is cellulose acetate, the method comprising:
   a. placing the fibrous material between at least an upper sheet and a lower sheet, wherein the upper sheet has a surface area that is greater than a surface area of an upper surface of the fibrous material and wherein the lower sheet has a surface area that is greater than a surface area of a lower surface of the fibrous material;

b. folding a portion of the lower sheet on opposing sides of the fibrous material to form lower folds along opposing edges of the opposing sides;

c. folding a portion of the upper sheet on the opposing sides of the fibrous material to form upper folds along opposing edges of the opposing sides;

d. applying a perimeter pass of a tape to a perimeter of the fibrous material to form a packaged fibrous bale, wherein the tape comprises an adhesive layer to connect the upper sheet and the lower sheet, wherein the tape has a tensile strength from 10 to 175 N/cm, inclusive; and e. compressing the fibrous material with a force from 45 to 455 metric tonnes, prior to placing the fibrous material between at least the upper sheet and the lower sheet, or after placing the fibrous material between at least the upper sheet and the lower sheet but prior to step b;

wherein the upper and lower sheets comprise a polymer film, and wherein the fibrous material is not restrained using straps.

2. The method of claim 1, wherein the tape has a surface area that covers at least 5% of a side surface area of the fibrous material.

3. The method of claim 1 wherein the upper sheet overlaps the lower sheet on each side of the fibrous material.

4. The method of claim 1 wherein the lower sheet overlaps the upper sheet on each side of the fibrous material.

5. The method of claim 1 wherein the method further comprises removing air bubbles from under the tape after the tape is applied to the perimeter.

6. The method of claim 1 wherein the tape has a shear strength from 0.5 $N/cm^2$ to 10 $N/cm^2$.

7. The method of claim 1 wherein the lower sheet and the upper sheet overlap by at least 5% of a total height of the packaged fibrous bale in a longitudinal direction of the packaged fibrous bale.

8. The method of claim 1 wherein the lower folds and upper folds are under folds.

9. The method of claim 1 wherein the lower sheet and the upper sheet are selected from the group consisting of cardboard, polyethylene, polypropylene, polybutylene, copolymers thereof and combinations thereof.

10. The method of claim 1 wherein the lower sheet and the upper sheet are woven, coated, knitted, and/or multilayer films.

11. The method of claim 1 wherein the fibrous material of step (a) comprises a non-sealed liner.

12. The method of claim 1 wherein the fibrous material is compressed prior to step (a).

13. The method of claim 1, wherein the packaged fibrous bale has a compressive force of up to 5 $N/cm^2$ at 48 hours after the compressing of the fibrous material.

* * * * *